United States Patent [19]

Miranda

[11] Patent Number: 4,562,776

[45] Date of Patent: Jan. 7, 1986

[54] MODULAR EXPANSIBLE INTERLOCKING SUPPORT STRUCTURE

[76] Inventor: Pedro A. Miranda, Calle 4, #A-18, Prado Alto Guaynabo, Puerto Rico 00657

[21] Appl. No.: 643,240

[22] Filed: Aug. 22, 1984

[51] Int. Cl.[4] ..... A47B 47/04

[52] U.S. Cl. ..... 108/111; 446/108; 108/153

[58] Field of Search ..... 108/111, 153; 297/157; 312/264; 211/189; 446/108, 114, 125

[56] References Cited

U.S. PATENT DOCUMENTS

| | | | |
|---|---|---|---|
| 3,141,423 | 7/1964 | Christensen | 108/111 |
| 3,612,289 | 10/1971 | Zink | 108/111 |
| 3,861,327 | 1/1975 | Silson | 108/111 X |
| 4,009,665 | 3/1977 | Weisheit | 108/111 |
| 4,130,971 | 12/1978 | Herrig | 108/111 X |
| 4,153,311 | 5/1979 | Takahashi | 108/111 X |

FOREIGN PATENT DOCUMENTS

| | | | |
|---|---|---|---|
| 207086 | 2/1908 | Fed. Rep. of Germany | 446/114 |

*Primary Examiner*—William E. Lyddane
*Assistant Examiner*—Peter A. Aschenbrenner
*Attorney, Agent, or Firm*—Donald W. Meeker

[57] ABSTRACT

Rectangular planar support members are slotted and interlocked to form vertical support structures. Elongated members slotted at each end are interlocked into the vertical support structure in horizontal and vertical orientations. The system is expansible in aligned or angled planes between vertical support structures spaced apart by the length of the elongated members. Components are easily assembled into myriad structures and disassembled to stack flat for storage. Each rectangular planar support member is slotted on four edges and provided with a tab on one edge. When the planar support members are interlocked together they form a column cross-shaped in cross-section and having slots extending in all four directions. The structural system therefore may be expanded in any of these directions by inserting elongated members in the slots and by adding columns as desired for multidirectional multiform structures.

20 Claims, 9 Drawing Figures

MODULAR EXPANSIBLE INTERLOCKING SUPPORT STRUCTURE

DESCRIPTION

BACKGROUND OF THE INVENTION

1. Technical Field

The present invention relates to structural support systems, and in particular, to an expansible adaptable structural system which is easily assembled and disassembled and which employs interlocking modular elements to form a desired structure with no need for fasteners or other supports and no need for tools in erecting the structure.

2. Background Art

Most prior art structural systems require fasteners of some kind to maintain the integrity of the structure and additionally require tools to apply the fasteners to the system and assemble the system. The fasteners are often the greatest cause for failure of the structures because they loosen over time and the connections essential to the structural integrity are broken.

Interlocking structural systems are usually custom designed for a particular function with each component especially shaped to fit a particular part of a particular structure for a particular use. No flexibility is provided because of the need for precision fitting all of the parts to maintain structural integrity.

Modular structural systems usually rely on fasteners to fit roughly mass produced components together to form the structure. Very often these components must be fabricated of a particular type of material because of the use for which the modular structure is intended.

In most shelving structural systems the vertical supports serve as a barrier and do not permit the extension of each shelf plane beyond the vertical upright in a continuous plane.

Generally only two points of support are provided at each end of each shelf in structural systems for shelving.

There is generally no rigid torque resistant elements in modular structural systems to prevent the structure from warping out of alignment.

In shelving structures with no interconnecting back element there is a tendency for the vertical support elements to slide apart.

DISCLOSURE OF INVENTION

Notched planar elements interlock to form a rigid structure with no need for fasteners or other support and no need for tools to fabricate the structure. Rigid planar elements slotted together and edge tab and slot interconnections between adjacent elements maintain structural integrity.

Modular components may be integrated together in various combinations to form any desired structure, variable in size, shape and function. Small rectangular vertical elements link together to form columnar supports. Elongated cross members interconnect between the columnar supports to form vertical and horizontal (or angled) planes for any desired support or display purposes including: bookshelves, partitions, walls, furniture, wine racks, commercial displays, storage space, computer/stereo/video stands, building blocks, concrete reinforcing elements, scaffolding and others. Systems turn corners for stability in forming U-shaped bays and enclosed cubicles.

Precisely shaped planar modular components are designed to be mass produced of any desired material and then fit snugly together in three or more planes to form a rigid structure which may easily be assembled, disassembled, rearranged as desired and stored compactly stacked as flat elements when not in use. Elements could be fabricated of wood, plywood, press board, fiberglass, plastic, metal, cardboard, plaster, concrete or any other rigid material formable into a planar structure.

Interlocking notched small rectangular elements stack to form vertical supports between which flat elongated elements are linked by at least two notches in an end of each elongated element: one along the longitudinal axis of the elongated element to receive a notched vertical element aligned with that axis, and another along the middle of the edge at the end of the elongated element leaving a short tab on either side of the end notch to be inserted in each of two slots of vertical elements with the remainder of the plane of the vertical element positioned in the notch of the elongated element, which plane is orthogonal to the longitudinal axis of the elongated element. By inserting the two tabs halfway into the vertical element notches another elongated element in a similar horizontal plane may be inserted from the opposite side of the vertical element to form a continuous horizontal plane on both sides of the vertical element.

Having each elongated element supported by three portions of the vertical elements as described above provides great strength and stability to prevent tilting and help prevent sagging of the elongated element under a heavy load or an unbalanced load.

Interlocking slotted elements in three planes with each element at each end of the element contacted at three points prevents rotation of the structure under torsion forces so the structure does not warp out of alignment.

Cross struts lock into the vertical structural elements at the top and bottom and at other locations as desired, such as under horizontal elements for extra support or positioned as vertical wall components, thereby linking the vertical structural elements together to prevent them from sliding apart.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
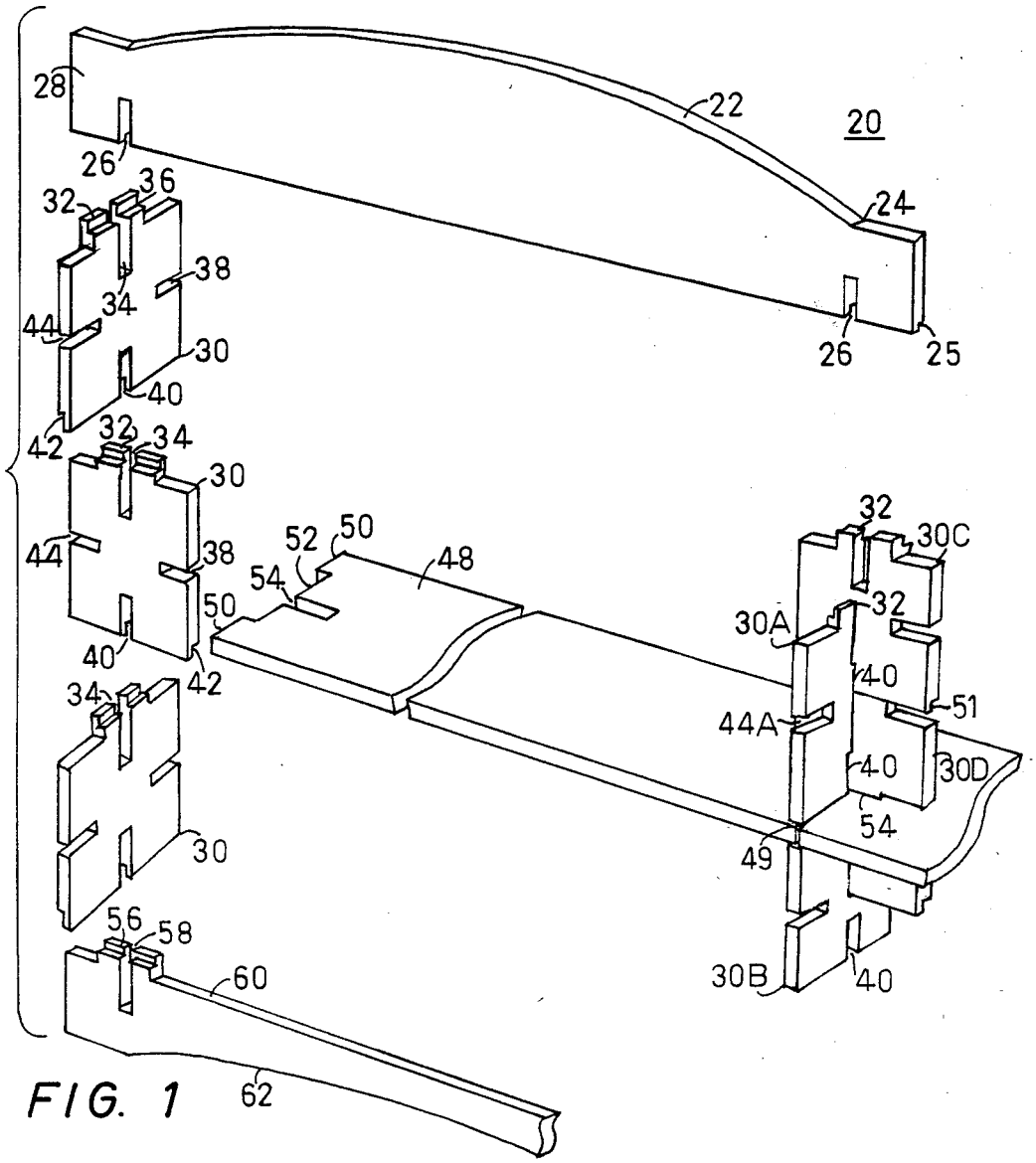
FIG. 1 is a perspective view of the components of the invention aligned for assembly.

In FIG. 1 the preferred embodiment of the invention 20 provides a series of planar structural support elements 30, on the left as they are aligned for assembly, and on the right as they are interlocked to form a vertical support structure. Each planar structural support element 30 comprises a flat rigid rectangular modular building unit provided with opposing slots 34 and 40 cut from the center of the top and bottom edges, respectively, and extending approximately one-fourth of the way into the body of the planar element 30. Each slot width is equal to the thickness of a planar element.

The structural support elements are interlocked together by angling alternate elements and inserting the top slot 34 of a lower element into the bottom slot 40 of an upper element thereby forming a vertical support structure with two assembled rigid intersecting vertical planes for strong support of members attached to the structure. The top edge of each planar element is further provided, on each side of the top slot, with a protruding tab 36 extending beyond the top edge of each planar element a distance equal to the thickness of an elongated horizontal member 48 which will be inserted between the vertical planar elements. Extending beyond each tab for half the thickness of the tab is a narrow tab extension 32. The bottom edge of each vertical planar element is cut away for half the thickness of the vertical planar element to provide a recess 42 to receive the tab extension 32 from the planar element below, thereby forming an interlocked vertical structural wall with the other elements in the same plane. By providing slots cut at different angles into each planar element the planar elements may intersect at any desired angle according to the slot angle.

Additional opposing lateral slots 38 and 44 similarly cut into the side edges of the structural support elements 30 provide stable support and flexibility in expanding the modular structure by receiving horizontal elongated members 48 fitting into the lateral slots 38 and 44 of the planar structural elements spaced at half planar element intervals or greater throughout the vertical structure. Lateral slots 38 and 44 further allow the modular structure to be extended away from the vertical support structure at an angle to the first set of elongated horizontal members 48 (see 48A in FIG. 6).

Elongated members 48, 24 and 60 formed of rigid flat boardlike material may be inserted into and supported by two vertical support structures spaced apart by the length of the elongated member. Each elongated member is provided with at least one slot 54, 26 and 58 respectively, cut into each member at an end of the elongated member. For a horizontal shelf-like support the elongated member 48 is provided with the slot 54 cut into the center of each end along the longitudinal axis of the elongated member. The end slot 54 is equal in width to the thickness of a structural planar element and in length to about one-fourth the width of a structural planar element. An additional edge slot 52 is cut into a central portion of the edge of the end of the elongated horizontal member leaving a protruding outside tab 50 on either side of the edge slot. As the horizontal elongated member is integrated into the vertical structural support the end slot 54 integrates with a lateral slot 38 (or 44) and the two outside tabs 50 integrate with lateral slots 49 formed between adjacent planar support members 30A and 30B. Conversely, the end slot could be inserted into a slot 51 formed between two planar support members 30C and 30D and the two outside tabs inserted into lateral slots 44A (and 38A not visible) in planar support element 30A.

For a horizontal elongated member oriented with faces in the vertical plane 24, 60, 90 and 120 at least one slot 26, 58, 100 and 116 respectively, is cut into a side edge of the elongated member adjacent each end. For top 24 and bottom 60 finishing cross struts, a single slot 26 and 58 respectively in the side at each end interlocks with a mating slot 34 and 40 respectively in each of two vertical support structures. In the bottom edge of the top cross strut 24 a recess 25 receives a tab extension 32 from a planar support member. In the top edge of the bottom cross strut 60 a tab extension 56 fits into a recess 42 in a planar support member. The top cross strut 24 and bottom cross strut 60 may be curved 22 and 62 respectively or otherwise decorated to finish off the structure. Each forms at each end a half vertical planar member to fit into the vertical support structure. See FIGS. 4 and 5 for Elements 90 and 120.

Intermediate elongated members oriented with faces in the vertical plane may be used as wall elements 90 or shelf support elements 120. In each case to fit into the vertical support structure each end of each elongated member so used must be shaped like a standard planar support member with each end having four slots 98, 102, 104, 106 in the wall element 90 and 116, 122, 124, 126 in the shelf support 120. All vertically inclined horizontal members with ends integrated into the vertical supports at each end serve to hold the vertical supports together. In each of the two intermediate elongated members 90 and 120, the end slots 102 and 122 respectively, are necessary for expansion of the system beyond the vertical support structure in alignment with the elongated members. For expansion of the system beyond the vertical support structure at an angle to the elongated members both end and inner slot are necessary (for wall element 90, slots 102 and 106, and for shelf support element 120, slots 122 and 126).

Figure 2:
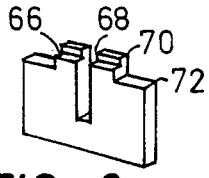
FIG. 2 is a perspective view of a half structural support element for the base of a vertical support portion of the invention.
Figure 3:
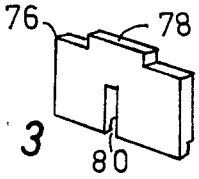
FIG. 3 is a perspective view of a half structural support element for the top of a vertical support portion of the invention.

In FIGS. 2 and 3, half planar support elements 72 and 76 serve to complete the bottom and top respectively of of a vertical support structure in place of the respective cross strut when not in use. Each half planar element is almost half the size of a full planar support element and is provided with only one slot, 68 in element 72 and 80 in element 76.

Figure 4:
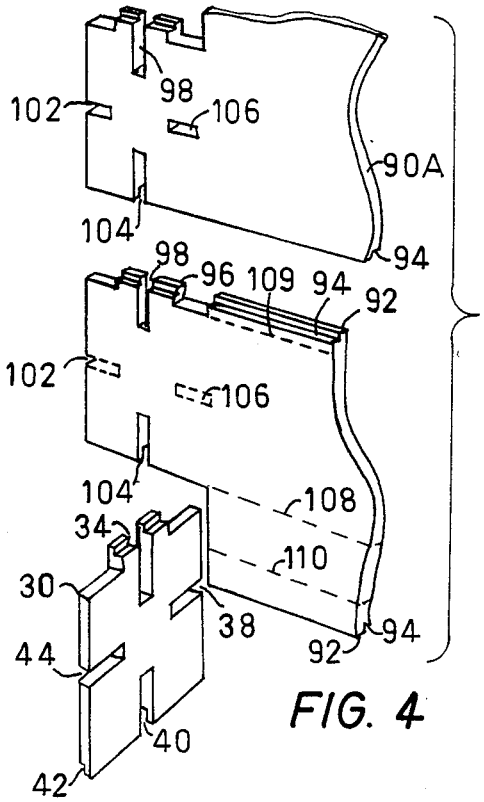
FIG. 4 is a perspective cut-away view of a vertical elongated member aligned for integrated assembly with the vertical structural elements.
Figure 5:
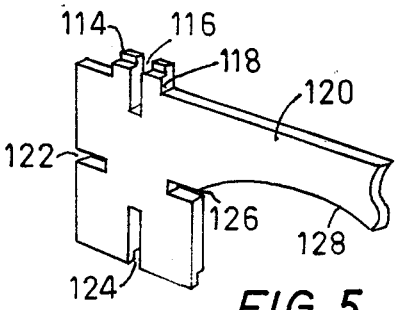
FIG. 5 is a perspective cut-away view of an alternate cross member with an end portion for integrating into the vertical support portion.
Figure 6:
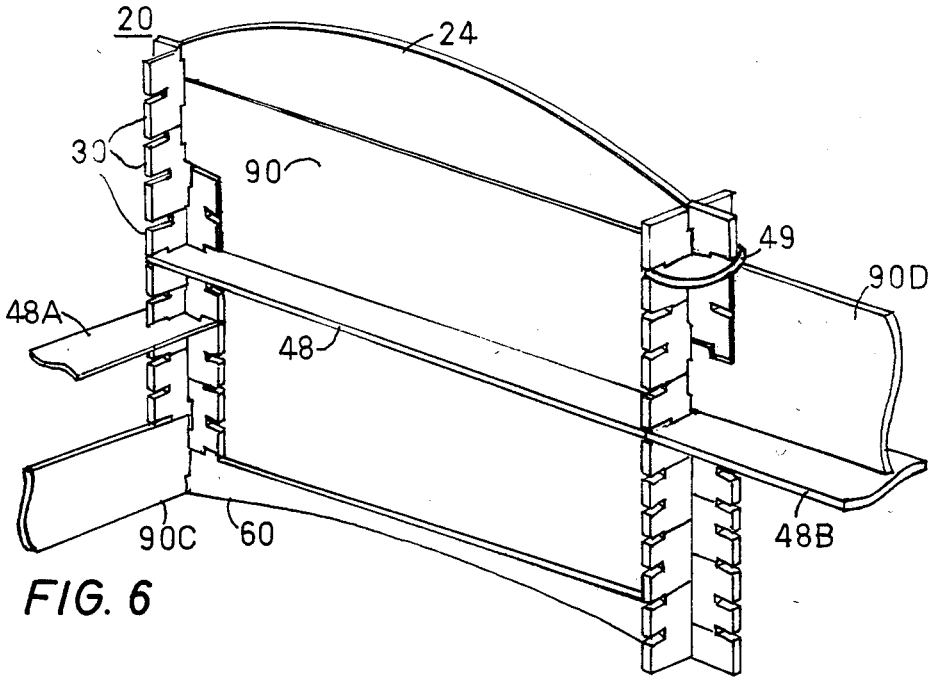
FIG. 6 is a perspective view of the components of the invention assembled into a bookcase structure with both vertical and horizontal cross members.
Figure 7:
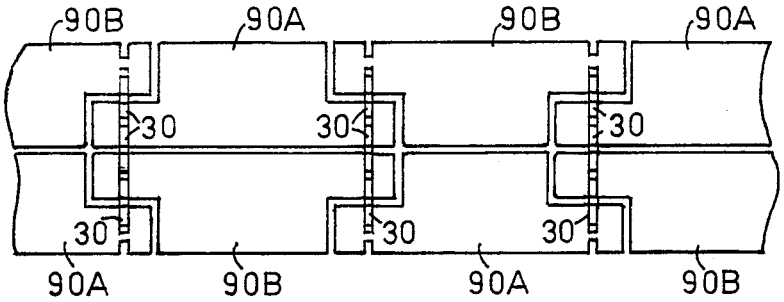
FIG. 7 is a partial elevational view of a wall structure formed by integrating vertical elongated members with a single plane of structural support elements.

In FIGS. 4 and 7 elongated partitions or wall elements 90A and 90B are integrated with the planar support elements 30 in the vertical support structure, with the end of each elongated member 90A and 90B replacing one of the planar support elements at each end. For a complete wall or partition as in FIG. 7 the elongated wall elements 90A and 90B are alternately inserted and stacked to serve as all of the elements in one plane of the vertical support structure integrated with the planar structural support elements 30 in the orthogonal vertical plane. In FIG. 4 for combining elongated horizontal wall-type members 90 with elongated horizontally oriented shelf members 48 in FIGS. 1 and 6 the wall member 90 can be cut off as indicated by dashed lines 108 and 109 for a shelf member linked into the same element of the vertical support structure, and 110 for a shelf member linked into a lower element of the vertical support structure. For a solid wall, interlocking ridges 92 and grooves 94 are provided in top and bottom edges of the wall members to form a tightly integrated wall structure.

In FIG. 6 a completely assembled shelf and wall system shows how elements interconnect between vertical supports to form shelves 48 and wall portions 90. In addition the system may expand beyond the vertical support structure to form aligned shelves 48B and wall portions 90D and angled shelves 48A and wall portions 90C which would connect to other vertical support structures not shown. An end shelf 49 is also shown.

Figure 8:
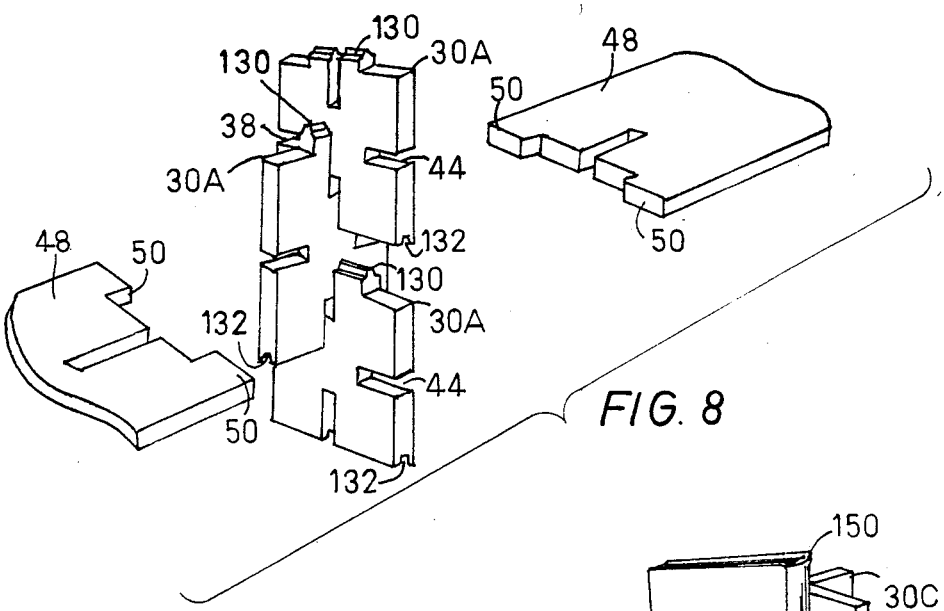
FIG. 8 is a partial perspective view of two elongated members with tongue and groove details aligned for integrating with vertical structural elements to produce a continuous horizontal plane across the vertical structural elements.

In FIG. 8 the planar support elements 30A are provided with interlocking tongue 130 and groove 132 details to provide greater stability in the system. The two shelf elements 48 are linked into opposite sides of a vertical support structure to form a continuous shelf in the same plane on both sides of the vertical support structure. Each outside tab 50 in each end of each shelf member 48 is inserted half way into a slot 38 and 44 in the vertical support structure.

Figure 9:
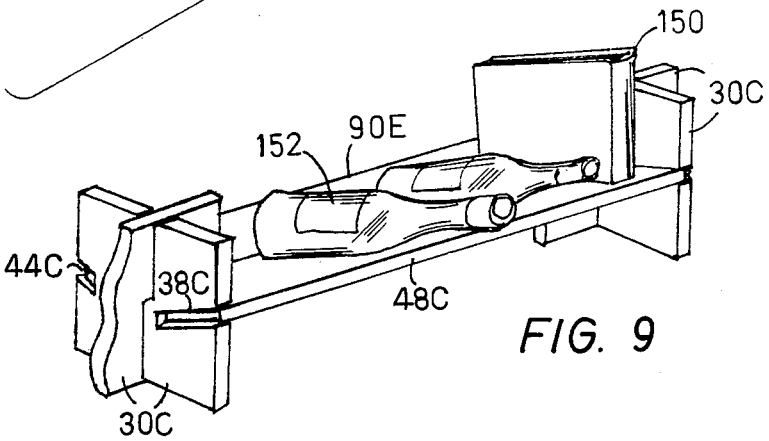
FIG. 9 is a perspective view of a combination wine rack and book rack constructed with the modular system using angle slots.

In FIG. 9 angled lateral slots 38C and 44C with angled shelf members 48C and vertical elongated wall-member 90E combine to form shelves for books 150 on wine bottles 152 stored at an angle with vertical end supports 30C. Many other structures and uses of the modular system are possible as indicated previously and the invention is not restricted to those illustrated but applies to the modular system itself which may be used as needed for multiple purposes where such a flexible collapsible and expansible system functions to serve the need.

It is understood that the preceding description is given merely by way of illustration and not in limitation of the invention and that various modifications may be made thereto without departing from the spirit of the invention as claimed.

I claim:

1. A modular interlocking structural system, expansible in size and shape and requiring no fasteners or external support, which interlocking structural system comprises:

a series of vertically interlocking planar structural support elements, each comprising a substantially rectangular flat rigid surface with at least two opposing edges each provided with a slot from the edge into the planar surface approximately one fourth the distance between the opposing edges, wherein the slot width is approximately equal to the thickness of the planar support element, and further comprising, at one slotted edge, a protruding tab extending beyond the edge a distance equal to the thickness of a planar support element centrally positioned on approximately half the edge and split by the slot, and further protruding from the tab, a tab extension means, and on an edge opposite to the tab edge, a recessed portion sufficiently large to receive a tab extension means, and wherein planar support elements are interlocked in alternating angular alignment by intersecting a tab edge of a first planar support element with a recessed edge of a second planar support element so that the slots interconnect thereby interlocking the two elements for half the length of each, and interconnecting a recessed edge of a third planar support element with the tab edge of the second planar support element at an angle so that the slots interconnect overlapping the second and third elements for half the length of each and thereby inserting the tab extension means of the first planar support element into the aligned recessed edge of the third planar support element, and thereby leaving lateral slots between the first and third planar support elements, so that all planar support elements are rigidly interconnected and multiple interlocked planar support elements form a vertical support structure;

a series of elongated planar members each comprising a long flat surface with at least one slot in each end extending from an edge into the surface of the elongated member for approximately one fourth the width of a planar support element, wherein each slot is approximately equal in width to the thickness of a planar support element;

wherein the elongated planar members are inserted into the vertical support structure by interlocking slots with at least one pair of vertical support structures serving to support at least one elongated planar member therebetween.

2. The invention of claim 1 wherein multiple elongated planar members are supported between multiple vertical support structures positioned at a variety of angles to form multi-directional multi-shaped structures.

3. The invention of claim 1 wherein each planar support element further comprises an additional similar slot in each of the two remaining opposing edges so that the vertical support structure comprises a series of slots on every side and the structural system may be extended on all sides of the vertical support structure by placing additional vertical support structures and connecting elongated planar members therebetween to form multi-directional multi-shaped structures.

4. The invention of claim 3 wherein an elongated planar shelf member comprises at least one slot in each end extending from the center of the edge at the end of the planar shelf member into the surface thereof for approximately one fourth the width of a planar support member, wherein each slot is approximately equal in width to the thickness of a planar support element, and each end further comprises a centrally positioned recess of the edge approximately equal in depth to half the thickness of a planar support element and in length to half the width of a planar support element, thereby protruding an outer tab on each side of the edge, wherein each outer tab is approximately equal in height to half the thickness of a planar support element and in length to the length of a slot in the vertical support structure, so that when each end of the elongated planar shelf member is inserted into a vertical support structure, the end slot of the elongated shelf member interconnects with a vertical support structure slot which is longitudinally aligned with the elongated member and the outer tabs of the elongated member are each inserted halfway into one of two vertical support structure slots laterally opposed to the longitudinal axis of the elongated member and a pair of vertical support structures each so engaged support the elongated shelf member therebetween as a load bearing member.

5. The invention of claim 4 wherein the plane of the elongated shelf member may be continued across a vertical support structure by inserting another elongated shelf member in an opposite side of the vertical support structure, inserting outer tabs from the second elongated shelf member into the other half of the same laterally opposing slots occupied by the outer tabs of the first elongated shelf member wherein the second elongated shelf member is supported at an opposite end by another vertical support structure.

6. The invention of claim 4 wherein the slots in the vertical support structure are cut at any desired angle to orient the elongated shelf member at the same angle.

7. The invention of claim 1 wherein an elongated planar member comprises at least one slot in a long edge of the elongated planar member adjacent to each end and the elongated member is interlocked with a vertical support slot in each of two vertical support structures, thereby tieing the two vertical support structures together.

8. The invention of claim 7 wherein the elongated planar member further comprises a tab protruding from the long edge at each slot and a tab extension means so that the elongated planar member interlocks with the vertical support structure at each end to form a vertically inclined horizontal finishing member across each of two ends of the two vertical support structures supporting the elongated planar member therebetween.

9. The invention of claim 7 wherein the elongated planar member further comprises a cut-away portion along the long edge of each slot, which cut-away portion receives a tab extension from a planar support element from an end of each of two vertical support structures supporting the elongated planar member therebetween to form a vertically inclined horizontal finishing member across the ends of the vertical support structures.

10. The invention of claim 7 wherein the elongated planar member comprises a slot in each of two opposing long edges adjacent to each end of the elongated planar member, wherein at each end the two slots are in alignment, the length of each slot is approximately equal to one fourth the width of a planar support element and the width of the slot is approximately equal to the thickness of a planar support element, and the width of each end is approximately equal to the height of at least one planar support element so that the elongated planar member interlocks between planar support elements to form a substantially vertically inclined wall member between vertical support structures.

11. The invention of claim 10 wherein each elongated wall member further comprises at least one tab means extending from one long edge and at least one cut-away portion in an opposite long edge all along a central portion of the elongated wall member between the vertical support structures, so that the cut-away portion of one elongated wall member receives the tab means of an adjacent elongated wall member to form an integrated vertical wall.

12. The invention of claim 10 wherein at least one of the long edges of the elongated wall member extends laterally away from the elongated wall member in a central portion corresponding, in length, to the distance between two vertical support structures and, in width, to at least the height of one planar support element, so that a series of such elongated wall members interlocked with supporting vertical support structures on non-adjacent planar support elements form a solid vertical wall, which may extend to adjacent vertical supports.

13. The invention of claim 1 wherein an elongated planar member comprises a slot in each end and a slot in each of the two long edges adjacent to each end of the elongated planar member, and further comprises a tab and tab extension protruding from one of the two long edges at each slot and a cut-away portion along the other of the two long edges at each opposite long edge slot, so that the cut-away portion of one such elongated planar member would receive the tab extension of a planar support member or another such elongated planar member if the two were positioned edge to edge, and wherein each of the two ends of the elongated planar member interlocks with each of two vertical support structures just as the planar support elements interlock, thereby forming a vertically inclined elongated member between the vertical support structures.

14. The invention of claim 13 wherein the vertically inclined elongated member further comprises at least one tab means extending from a long edge in a central portion of the vertically inclined elongated member between vertical support structures and along an opposite long edge at least one cut-away portion so that when such vertically inclined elongated members are positioned edge to edge they form an integrated vertical wall.

15. The invention of claim 13 wherein in one long edge of the vertically inclined elongated member in a central section between vertical support structures, a portion of the edge is removed to permit the placement of a horizontally inclined elongated member to be positioned between vertically inclined elongated members.

16. The invention of claim 13 wherein a central portion between vertical support structures of at least one long edge of the vertically inclined elongated member extends laterally away from the vertically inclined elongated member for at least the length of a planar support element, so that such vertically inclined elongated members in a series linked into spaced planar support elements form a solid vertical wall, which may be extended past the vertical support structures to other vertical support structures.

17. The invention of claim 13 wherein the vertically inclined elongated member further comprises an additional slot at each end located interiorly of the edge corresponding to a fourth slot on a planar support element, so that the vertically inclined elongated member may be interlocked into a vertical support structure at a corner for extension of the system beyond the vertical support structure in a lateral direction.

18. The invention of claim 1 wherein a half planar support element comprises a planar support element cut in half to finish an end of a vertical support structure.

19. A modular interlocking structural system, expansible in size and shape and requiring no fasteners or external support, which interlocking structural system comprises:

a series of vertically interlocking planar structural support elements, each comprising a substantially rectangular flat rigid surface with two pair of opposing edges, each edge provided with a slot from the edge into the planar surface approximately one fourth the distance between the opposing edges, wherein the slot width is approximately equal to the thickness of the planar element, and further comprising, at one slotted edge, a protruding tab extending beyond the edge a distance equal to the thickness of a planar support element centrally positioned on approximately half the edge and split by the slot, and further protruding from the tab, a tab extension means, and on an edge opposite to the tab edge, a recessed portion sufficiently large to receive a tab extension means, and wherein planar elements are interlocked in alternating angular alignment by intersecting a tab edge of a first planar support element with a recessed edge of a second planar support element so that the slots interconnect thereby interlocking the two elements for half the length of each, and interconnecting a recessed edge of a third planar structural element with the tab edge of the second element at an angle so that the slots interconnect overlapping the two elements and thereby inserting the tab extension means of the first element into the aligned recessed edge of the third element and thereby leaving lateral slots between the first and third elements, so that all planar elements are rigidly interlocked and multiple interlocked planar support elements form a vertical support structure wherein a vertical crossed core column radiates a series of four aligned fanned panels each separated from the adjacent aligned fanned panels by a series of four aligned slots;

a series of elongated planar members each comprising a long flat surface with at least one slot in each end extending from the edge into the surface for approximately one fourth the width of a planar support member, wherein each slot is approximately equal in width to the thickness of a planar support element, and each end further comprises a centrally positioned recess of the edge approximately equal in depth to half the thickness of a planar support element and in length to half the width of a planar support element, thereby protruding an outer tab on each side of the edge, wherein each outer tab is approximately equal in height to half the thickness of a planar support element and in length to the length of a slot in the vertical support structure;

wherein each end of an elongated member is inserted into one of at least a pair of vertical support structures so that the end slot of the elongated member interconnects with a vertical support structure slot which is longitudinally aligned with the elongated member and the outer tabs of the elongated member are each inserted halfway into one of two vertical support structure slots laterally opposed to the longitudinal axis of the elongated member and the pair of vertical support structures support the elongated member therebetween as a horizontally oriented load bearing member.

20. The invention of claim 19 further comprising at least one elongated planar member with each of two ends sized and shaped like a planar support element, wherein each such shaped end is integrated into a vertical support structure in place of a corresponding planar structural support element so that the elongated planar member thus integrated forms a vertically inclined element between the vertical support structure.

* * * * *